US005630658A

United States Patent [19]

Jeter

[11] Patent Number: 5,630,658

[45] Date of Patent: May 20, 1997

[54] HEMMED EDGE FILE HOLDER

[75] Inventor: Jack W. Jeter, Akron, Ohio

[73] Assignee: Jeter Systems Corporation, Akron, Ohio

[21] Appl. No.: 664,794

[22] Filed: Jun. 17, 1996

Related U.S. Application Data

[63] Continuation of Ser. No. 405,365, Mar. 16, 1995, abandoned.

[51] Int. Cl.[6] ..... A47B 87/02

[52] U.S. Cl. ..... 312/107; 312/111; 312/108; 108/91; 206/509; 206/425; 220/652

[58] Field of Search ..... 312/107, 108, 312/111, 198.1, 257.1; 206/425, 509; 220/553, 650; 108/91, 153; 211/135, 188, 194

[56] References Cited

U.S. PATENT DOCUMENTS

| | | | |
|---|---|---|---|
| 640,078 | 12/1899 | Baker | 312/107 |
| 2,012,857 | 8/1935 | Scheinman et al. | 206/425 |
| 2,095,583 | 10/1937 | Wigeland et al. | 312/108 |
| 2,118,011 | 5/1938 | Zalkind | 312/108 |
| 2,318,655 | 5/1943 | Zalkind | 206/425 |
| 2,386,343 | 10/1945 | Regenhardt | 312/107 |
| 2,614,016 | 10/1952 | Regenhardt | 312/111 |
| 2,997,201 | 8/1961 | Prato | 206/509 |
| 3,047,157 | 7/1962 | Bergman | 206/509 X |
| 3,062,402 | 11/1962 | Farrell et al. | 220/652 |
| 3,112,044 | 11/1963 | Larsen et al. | 220/652 X |
| 3,279,873 | 10/1966 | Gronquist | 312/111 X |
| 3,748,006 | 7/1973 | Levit et al. | 312/111 |
| 4,148,454 | 4/1979 | Carlson et al. | 312/111 X |

FOREIGN PATENT DOCUMENTS

| | | | |
|---|---|---|---|
| 685073 | 7/1930 | France | 312/107 |
| 2261943 | 9/1975 | France | 206/509 |
| 2573037 | 5/1986 | France | 206/425 |
| 2403198 | 7/1974 | Germany | 108/91 |

*Primary Examiner*—Peter M. Cuomo
*Assistant Examiner*—Rodney B. White
*Attorney, Agent, or Firm*—Renner, Kenner, Greive, Bobak, Taylor & Weber

[57] ABSTRACT

A file holder for holding a plurality of file folders, wherein a support surface and a plurality of perpendicularly extending side panels have a hemmed support edge and a hemmed panel edges, respectively. The hemmed support edge and the hemmed panel edges provide structural strength to the file holder while providing a file opening which has increased space for the easy insertion and extraction of file folder and a file holder with relatively smooth surfaces that do not catch or tear the file folders. The file holder also has a plurality of dividers which are secured to the support surface and a back wall and which provide additional structural support when a file holder is stacked on another file holder or other shelving. The file holders are constructed with attachment holes and nesting members so that multiple file holders can be stacked on one another.

11 Claims, 3 Drawing Sheets

HEMMED EDGE FILE HOLDER

This is a continuation of the application Ser. No. 08/405,365, filed Mar. 16, 1995, now abandoned.

TECHNICAL FIELD

The invention herein resides generally in the art of open faced file holders for holding a plurality of filing folders. More particularly, the present invention relates to an open faced file folder with hemmed surface edges and hemmed side edges to provide more clearance and prevent excessive wear on file folders as they are extracted and inserted.

BACKGROUND ART

Various methods of holding file folders are well known. One common method of storing filing folders is to employ drawer-type filing cabinets. Where space is not a concern, front facing drawer-type filing cabinets are frequently used. Front facing filing cabinets allow a clerk to pull open the drawer and leaf through the file folders until the desired file is found. Where space is a concern, such as in a hallway or corridor, side facing drawer-type filing cabinets are employed. Side facing filing cabinets allow the clerk to open the drawer and access the file folder from its side or front depending upon how the file is stored in the drawer. However, use of drawer-type filing cabinets is inefficient in that the drawer must be pulled away from the cabinet in order to access the file folders. The drawers also add to the cost of such filing systems.

Open-face shelf filing systems have been developed in order to overcome the need for opening and closing a drawer-type filing cabinet and reduce the cost thereof. Typically, open-face shelf filing systems are constructed so that the file folders have exposed vertical edges. The clerk only has to approach the shelf filing system and locate the desired file folder. To assist in locating the desired file folder, the vertical edges of the file folders typically have color coded marking indicia attached thereto for easy identification. It is also known that the side panels of open-face shelf filing systems can be slanted at an angle so that the vertical edges of the file folders are more easily visualized. In order to provide the open face shelf filing systems with the required structural strength, it is well known to provide the shelves and side panels with right angle flanges. It is also well known that dividers can be vertically disposed on the shelves for the purpose of classifying groups of files in the filing system and to provide additional structural strength.

Although the open-face shelf filing system is effective for storing file folders, it is apparent that the current construction has several drawbacks. Primarily, the right angle flanges used to increase shelf strength reduce the amount of usable file folder space. Moreover, the right angle flanges overhang adjacent shelves so that the file folders on the adjacent shelves tend to catch and become worn as they are inserted or extracted. Another drawback of current open-face shelf filing systems is that the vertical dividers employed are often of a non-uniform construction from one divider to the next and therefore do not provide reliable structural support to adjacent shelves.

Based upon the foregoing, it is evident that there is a need in the art for an open-face shelf filing system with low profile shelves and side panels which has the same structural strength as previous filing systems. There is also a need to provide a file holder with dividers that have consistent center-to-center spacing between supporting flanges so that the dividers provide supporting structural integrity to the filing system.

DISCLOSURE OF THE INVENTION

In light of the foregoing, it is a first aspect of the present invention to provide an open-face file holder system which has shelves and side panels with hemmed edges.

Another aspect of the present invention is to provide a file holder with hemmed edges, wherein the edges of the shelves and side panels are hemmed upon themselves so as to provide structural strength to the shelving.

Still a further aspect of the present invention is to provide a file holder system with hemmed edge shelves and side panels that has increased usable space for the file folders received therein.

An additional aspect of the present invention is to provide a file holder system wherein the file folders received therein do not catch or tear on the hemmed edge shelves and side panels.

Yet an additional aspect of the present invention is to provide a file holder system, that has a plurality of dividers with equal center-to-center spaced flanges disposed on the shelves so as to provide additional strength to the file holder system.

The foregoing and other aspects of the invention which shall become apparent as the detailed description proceeds are achieved by a file holder, comprising: a support surface having a hemmed support edge; and a plurality of panels carried by the support surface and substantially perpendicular thereto, wherein the plurality of panels have a hemmed panel edge.

The present invention also provides a file holder, comprising: a support surface having a hemmed support edge which has an outer support surface opposite an inner support surface that bears upon itself; and a plurality of panels substantially perpendicular to the support surface having a hemmed panel edge, wherein the hemmed panel edge has an outer panel surface opposite an inner panel surface that bears upon itself.

BEST MODE FOR CARRYING OUT THE INVENTION

Figure 1:
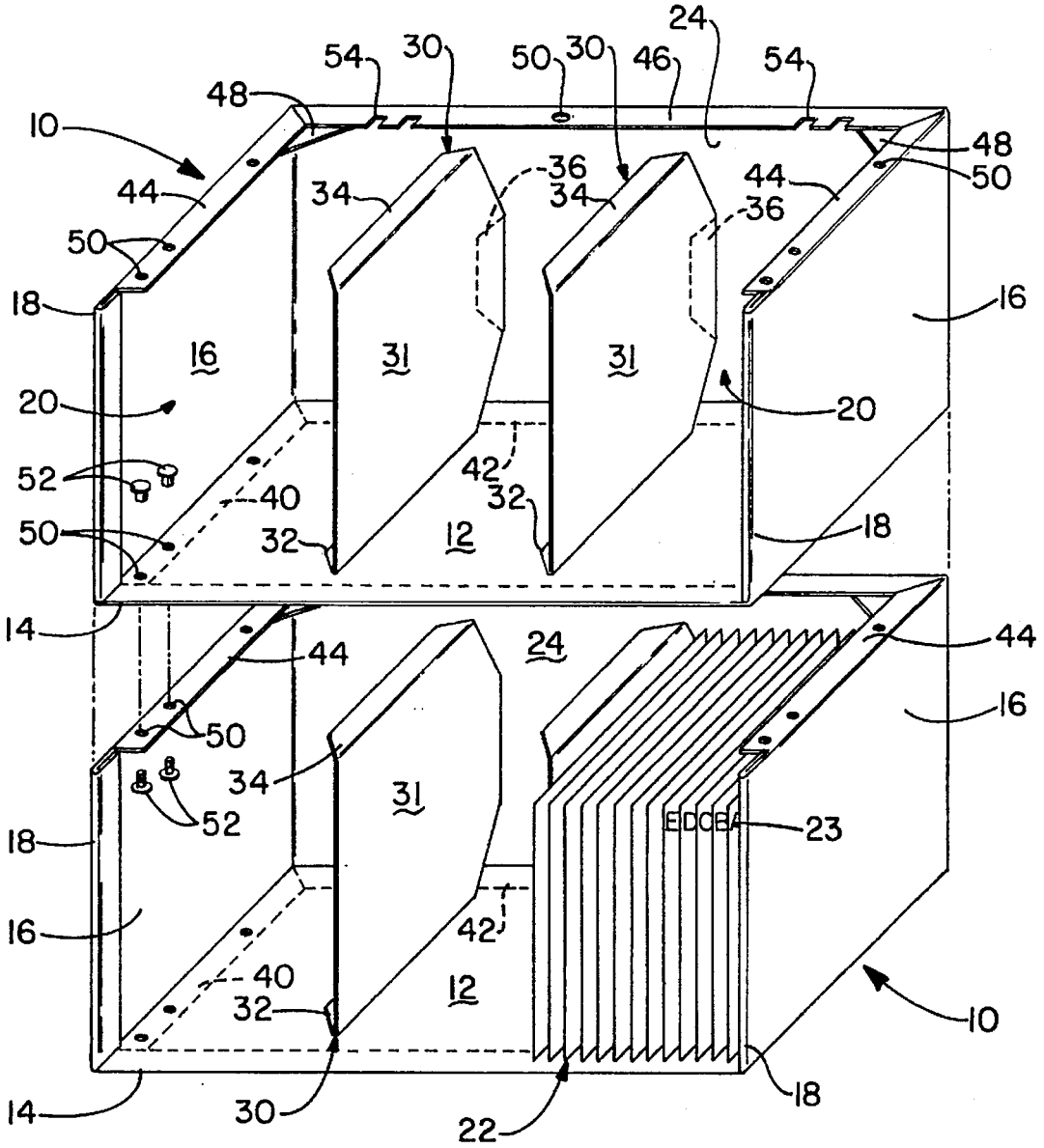
FIG. 1 is a perspective view of a file holder with hemmed edges holding a plurality of file folders and illustrating that the file holder is mateable with other file holders of similar construction.

Referring now to the drawings and more particularly to FIG. 1, it can be seen that a file holder according to the present invention is designated generally by the numeral 10. Generally, the file holder 10 includes a support surface 12 which has a hemmed support edge 14 and a plurality of panels 16 which have hemmed panel edges 18. As will be described in further detail below, the file holder 10 with a hemmed support edge 14 and hemmed panel edges 18 provides a file holder which is structurally stable and provides increased space for inserting and extracting file folders. It will be appreciated that the file holder 10 is manufactured from a rigid material, such as sheet metal.

In particular, the file holder 10 has a support surface 12 that provides a level surface which can rest either on a floor or on a like file holder 10. The support surface 12 has a hemmed support edge 14 that provides increased structural strength to the support surface 12 so that it does not easily bend or deform. Substantially perpendicular to the support surface 12 are panels 16 which have hemmed panel edges 18. The hemmed panel edges 18 provide increased structural strength for the panels 16 in much the same manner as the hemmed support edge 14. The support surface 12 is carried by the panels 16 so that file folder openings 20 are created for receiving a plurality of file folders 22. The file folders 22 have marking indicia 23 on their exposed vertical edges. A back wall 24, which is perpendicular to both the support surface 12 and the panels 16, is integral with the panels 16 so as to provide a stopping surface for the file folders 22.

Figure 2:
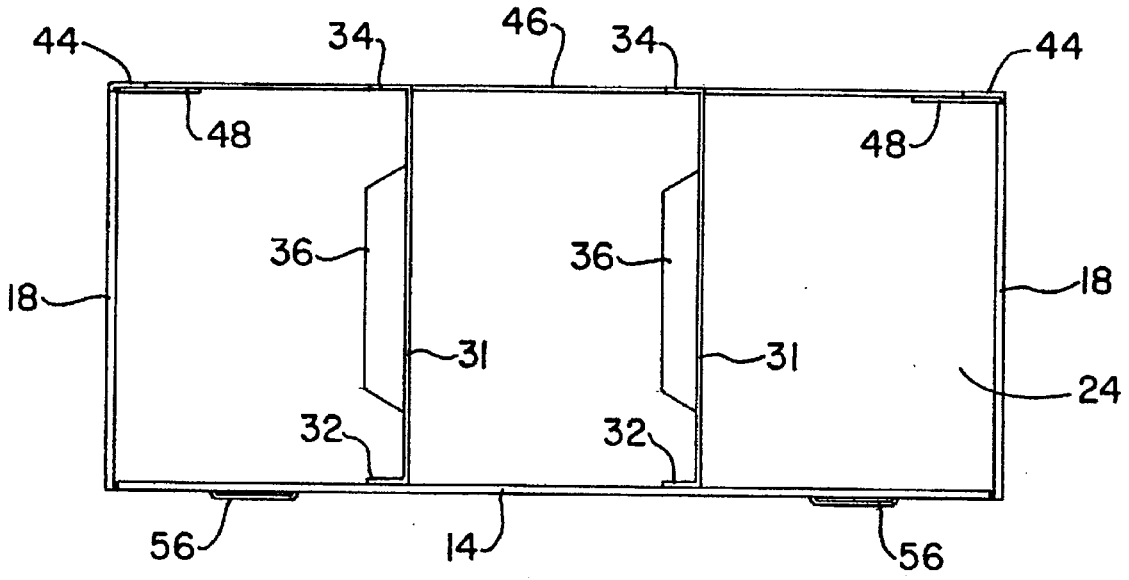
FIG. 2 is a front elevational view of a single file holder with hemmed edged shelves and side panels.

Referring now to FIGS. 1 and 2, it can be seen that a plurality of dividers 30 are carried and secured to the file holder 10 for laterally supporting and further classifying the file folders 22. Each divider 30 has a body 31 which has a predetermined center-to-center spacing between a perpendicularly extending support flange 32 and a perpendicularly extending top flange 34. The body 31 also has a perpendicularly extending wall flange 36. As those skilled in the art will appreciate, the support flange 32 is secured to the support surface 12 by any known means such as spot welding or by rivets. In much the same manner, the wall flange 36 is secured to the back wall 24. As will be discussed in further detail below, the top flange 34 is employed to support additional file holders stacked on the file holder 10.

The panels 16 and back wall 24, which in the preferred embodiment is a single piece of sheet metal, have a panel ledge 40 and a back ledge 42 respectively. The panel ledge 40 is substantially perpendicular to the panel 16 and extends inwardly. In a similar manner, the back ledge 42 is substantially perpendicular to the back wall 24 and extends inwardly. As those skilled in the art will appreciate, the support surface 12 is carried and secured to the panel ledges 40 and the back ledge 42.

The panels 16 and the back wall 24 also have a side attachment ledge 44 and a back attachment ledge 46, respectively. The side attachment ledge 44 is substantially perpendicular to the panels 16 and extends inwardly. In a similar manner, the back attachment ledge 46 is substantially perpendicular to the back wall 24 and also extends inwardly. Corner pieces 48 are employed to interconnect each end of the back attachment ledge 46 to the adjacent side attachment ledges 44. The attachment ledges 44 and 46, the panel ledge 40 and back ledge 42 have attachment holes 50. The aligned attachment holes 50 allow the panel ledge 40 to be secured to the attachment ledge 44 of a second file holder 10 by rivets 52 or the like. Likewise, the attachment holes 50 on the back ledge 42 are aligned with the attachment holes 50 on the attachment ledge 46.

As best seen in FIG. 2, to further assist in securing a file holder 10 to a like file holder 10 or other file holders, the attachment ledge 46 has nesting members or attachment notches 54 that are mateable with a nesting member or buckle 56 on the back ledge 42.

Figure 3:
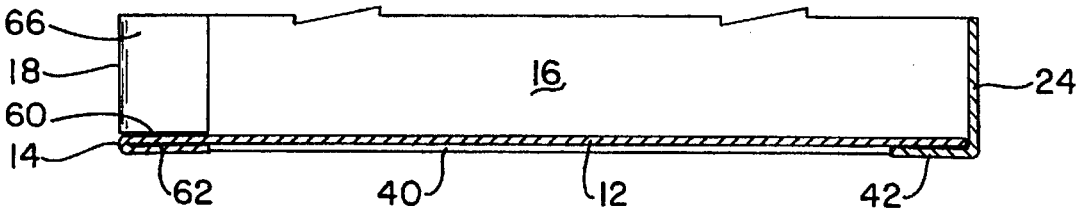
FIG. 3 is an enlarged transverse sectional view through the left end of a file holder with the upper portion thereof broken away.

Referring now to FIG. 3, an enlarged view of the hemmed support edge 14 is shown. As discussed earlier, the support surface 12 is supported and carried by the panel ledges 40. The hemmed support edge 14 has an outer support surface 60 opposite an inner support surface 62. Those skilled in the art will appreciate that the inner support surface 62 is hemmed or folded in such a manner that it bears upon itself. In the preferred embodiment, the hemmed support edge 14 is hemmed so it is disposed underneath the support surface 12. In other words, the plurality of file folders 22 rest on the support surface 12 opposite the hemmed support edge 14. It will be appreciated that the hemmed support edge 14 is of sufficient depth that file folders 22 supported by the second file holder 10, beneath the first file holder 10, will not catch or tear on the hemmed support edge 14.

Figure 4:
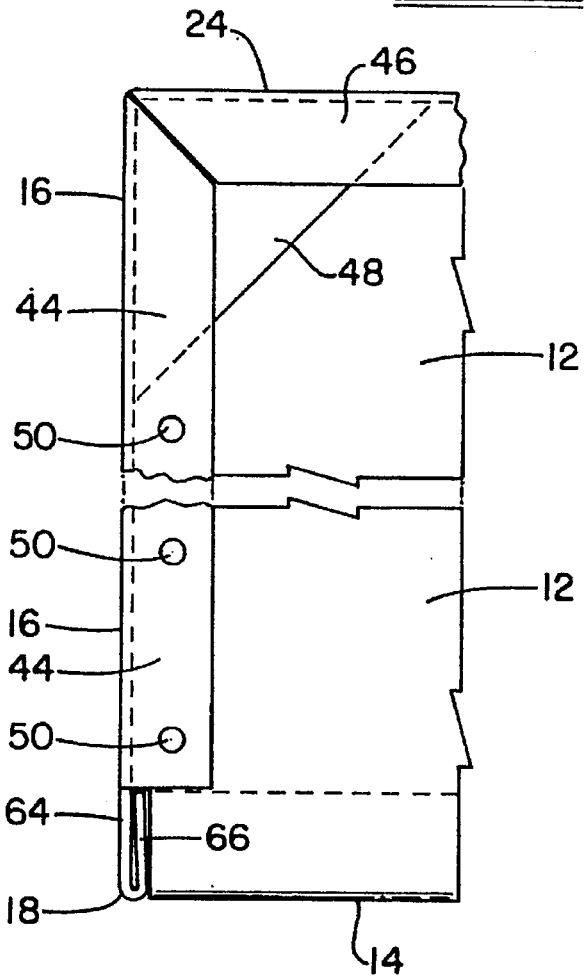
FIG. 4 is an enlarged top view of the left end of a file holder with portions being broken away.

As seen in FIG. 4, the hemmed panel edge 18 is constructed in a manner similar to the hemmed support edge 14. In particular, the panel 16 has an outer panel surface 64 opposite an inner panel surface 66 so that when the hemmed panel edge 18 is formed, the inner panel surface 66 bears upon itself. In the preferred embodiment, the hemmed panel edge 18 is directed inwardly within the file folder 10. Those skilled in the art will appreciate that the hemmed panel edge 18 is of sufficient depth that the sides of file folders 22 do not catch or tear on the panel edge 18 when extracted or inserted.

In actual use, the file holder 10 is placed on a level floor or other stable surface so that the file openings 20 face outwardly. A clerk can then easily insert and extract file folders 22 based on marking indicia 23 disposed thereon. It will be appreciated that since the file holder 10 has hemmed support edge 14 and hemmed panels edges 18 that the file folders 22 can not catch or tear as they are inserted and extracted.

Another feature in the use of the file holder 10 is that the nesting member 56, which is disposed on the underside of the back ledge 42, is mateable with the nesting member 54 disposed on the attachment ledge 46 of a second file holder 10. In particular, the underside of the back ledge 42 has a buckle 56 which is mateable with attachment notches 54 on the attachment ledge 46 of a second file holder 10. As such, multiple file holders 10 can be stacked on one another or configured in any manner desired by the clerk. To further enhance this stacking feature, the dividers 30 are constructed to support the underside of a support surface 12. In particular, the vertical divider 30 has a support flange 32 secured to the support surface 12 and a wall flange 36 secured to the back wall 24 in a manner well known in the art. Therefore, when the file holder 10 is stacked on top of a second file holder 10, the top flange 34 is placed in a bearing relationship with the underside of the support surface 12.

The body 31 of each of the dividers 30 has a highly accurate predetermined center-to-center spacing between the support flange 32 and the top flange 34 to allow for this effective stacking of the file holders 10. In the prior art, the dividers 30 were formed from blanks by bending the flanges 32, 34 to specific dimensions. Accordingly, the height of the body 31 was established by whatever material remained between the bends of the flanges. Thus, if the blank were oversized or undersized, the resultant body portion 31 would be similarly missized and the height of the divider 30 would vary from its desired height. According to the instant invention, the body portion 31 is the controlling dimension of the divider 30, with the flanges 32, 34 being formed off of center-to-center measurements of the body portion 31. As a result, while the dimensions of the flanges 32, 34 may vary from divider to divider, the heights of the dividers are uniform and consistent.

Figure 5:
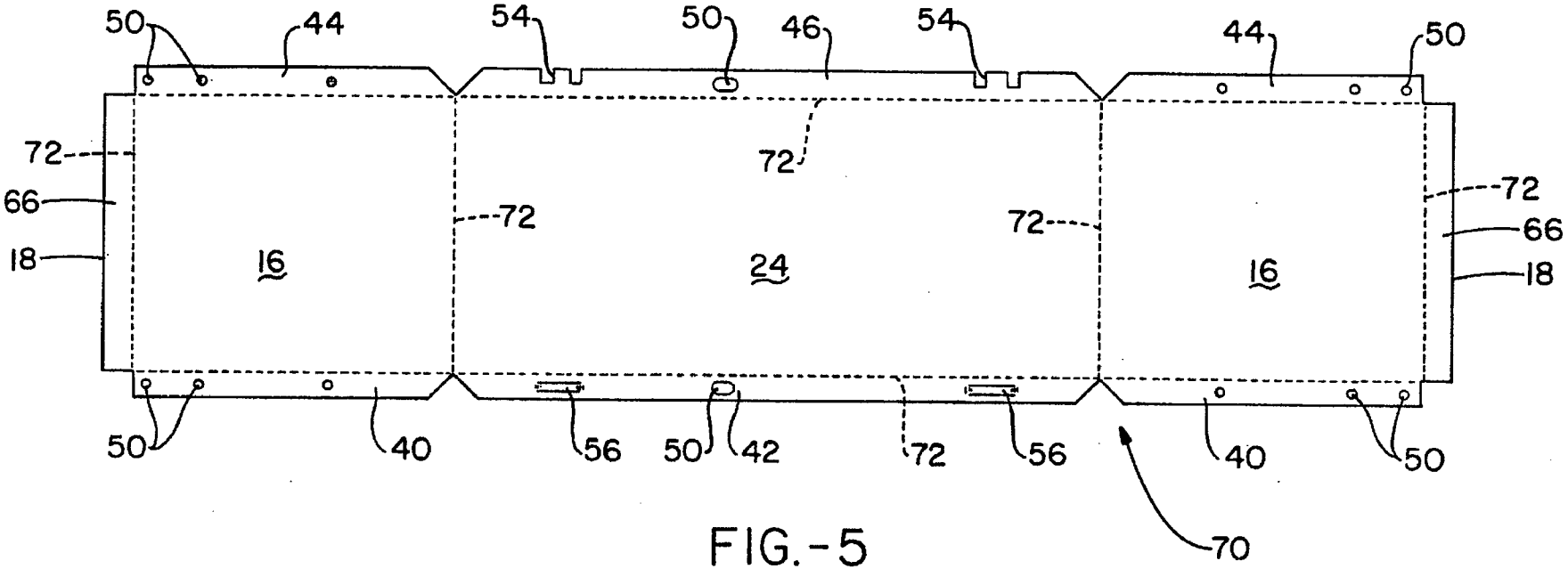
FIG. 5 is a plan view of a primary member forming the side and backwall panels of a file holder.

In a similar manner, FIG. 5 shows a blank 70 that is used to form the panels 16 and the backwall 24 with an accurate and consistent center-to-center spacing between hemmed panel edges 18, between the attachment ledge 46 and the back ledge 42, between the panel ledges 40 and the attachment ledges 44, and between respective side panels 16. The blank 70 has a highly accurate predetermined center-to-center spacing between fold lines 72 which define the height and width of the back wall 24 and the side panels 16. As such, the exposed sides of the remaining material of the blank 70 are employed to form the hemmed edges 18, the panel ledges 40, the back ledge 42, the attachment ledges 44, and the attachment ledge 46. By employing center-to-center spacing to form the back wall 24 and the side panels 16, the height and width of the file holder 10 remains uniform and consistent to facilitate the stacking thereof.

As is well known in the art, the bending of a piece of sheet metal strengthens that sheet metal along that edge. Accordingly, the hemmed support edge 14 and the hemmed panel edge 18 strengthens the file holder 10 so that it can support the weight of other file holders and like folders.

From the above description, it should be apparent that the insertion and extraction of file folders 22 is greatly enhanced by the use of the file holder 10. Primarily, the reduced profile of the hemmed support edge 14 and the hemmed panel edges 18 provide increased space for the insertion and extraction of file folders 22 by a clerk employing the file holder 10. The low profile of the hemmed support edge 14 and hemmed panel edges 18 also provides a relatively smooth surface that does not catch any corner of a file folder 22. This is an advantage in that the file folder 22 is not exposed to the excessive wear and tear normally caused by shelving that has downwardly extending flanges.

It will be appreciated, that the low profile of the hemmed support edge 14 and the hemmed panel edges 18 provides a space savings from top to bottom and side to side. As such, this allows for the possibility of securing more file holders 10 to a wall and it also provides a more pleasing appearance over the normal flanged shelf construction.

A further advantage of the present file holder 10 is that it can be stacked on top of or side by side with additional file holders 10. This is accomplished by virtue of the mating features of the buckles 56 being receivable with the attachment notches 54. Multiple file holders 10 are secured to one another by employing the rivets 52 through the attachment holes 50 in a manner well known in the art. An additional advantage of the present invention is that the dividers 30 have a body 31 with highly accurate center-to-center spacing such that the top flange 34 contacts and supports the underside of a support surface 12 of a second file holder 10.

Yet another advantage is that the back 24 and the side panels 16 have accurate and consistent dimensional properties so that multiple file holders may be stacked with minimal waste of space.

Thus, it can be seen that the objects of the invention have been satisfied by the structure presented above. It should be apparent to those skilled in the art that the objects of the invention can be practiced for any size file holder and could be adapted for side panels that are vertical or in a slanted direction.

While the preferred embodiment of the invention has been presented and described in detail, it will be understood that the invention is not limited thereto or thereby. Accordingly, for an appreciation of the true scope and breadth of the invention, reference should be made to the following claims.

What is claimed is:

1. A file holder, comprising:

a support surface having a hemmed support edge at a front edge of said support surface, said hemmed support edge comprising an edge portion of said support surface folded back into itself at an underside of said support surface and wherein said inner support surface is substantially parallel with said support surface; and a plurality of panels carried by said support surface and substantially perpendicular thereto, each of said plurality of panels having a hemmed panel edge at a front edge of said panel, wherein said support surface and said plurality of panels form a file folder opening for receiving a plurality of file folders which rest upon both said support surface and said edge portion;

said hemmed support edge has an outer support surface that is a coplanar continuation of said support surface and opposite said inner support surface, and wherein said hemmed panel edge has an outer panel surface disposed inwardly and substantially parallel with and opposite an inner panel surface such that said inner panel surface bears upon itself, said hemmed panel edge extending orthogonally with respect to said hemmed support edge.

2. The file holder according to claim 1, wherein each of said plurality of panels has an inwardly extending panel ledge perpendicular to said panel and an inwardly extending attachment ledge perpendicular to said panel and wherein both said panel ledge and said attachment holes so that the file holder can be secured to a second file holder.

3. The file holder according to claim 2, further comprising:

a plurality of dividers substantially perpendicular to said support surface so as to form a plurality of file folder openings; and a back wall substantially perpendicular to both said support surface and said plurality of panels wherein each of said plurality of dividers has a body which has a perpendicularly extending support flange, a perpendicularly extending top flange and a wall flange, said support flange and said top flange having a predetermined center-to-center spacing therebetween, said support flange is secured to said support surface and said wall flange is secured to said back wall.

4. The file holder according to claim 3, wherein said back wall has an inwardly extending attachment ledge with a plurality of notches, and an inwardly extending back ledge with a plurality of buckles so that said plurality of notches are receivable by said plurality of buckles of other file holders.

5. A file holder, comprising:

a support surface having a hemmed support edge at a front edge of said support surface which has an outer support surface that is a coplanar continuation of said support surface, wherein said outer support surface is opposite an inner support surface that bears upon itself at an underside of said support surface and wherein said inner support surface is substantially parallel with said support surface, both said support surface and said hemmed support edge supporting a plurality of file folders; and a plurality of panels substantially perpendicular to said support surface having respective hemmed panel edges at a front edge of said panel, wherein each of said hemmed panel edges has an outer panel surface disposed inwardly, substantially parallel with and opposite an inner panel surface that bears upon itself, said hemmed panel edges extending orthogonally with respect to said support surface.

6. The file holder according to claim 5, wherein said support surface and said plurality of panels form a file folder opening for receiving a plurality of file folders which rest upon both said support surface and said outer support surface.

7. The file holder, according to claim 6, further comprising:

a back wall substantially perpendicular to both said support surface and said plurality of panels, wherein said back wall has an inwardly extending attachment ledge with a plurality of notches and an inwardly extending back ledge with a plurality of buckles so that said plurality of notches are receivable by other file holders having said plurality of buckles.

8. The file holder according to claim 7, further comprising:

a plurality of dividers substantially perpendicular to said support surface so as to form a plurality of file folder openings, wherein each of said plurality of dividers has a body and a plurality of perpendicularly extending flanges which are secured to said support surface and to said back wall.

9. The file holder, according to claim 8, wherein said plurality of panels has a plurality of inwardly extending ledges with aligned attachment holes so the hemmed edge file holder can be secured to another hemmed edge file holder by securing rivets through said attachment holes.

10. The file holder, according to claim 8, wherein each of said dividers is formed from a blank establishing an exact height for said body and with said flanges being formed of remaining materials from said blank on each side of said body.

11. The file holder, according to claim 8, wherein said plurality of panels and said back wall is formed from a blank establishing an exact height and width for said plurality of panels and said back wall and with said hemmed panel edges, said attachment ledge and said back ledge being formed of remaining materials from said blank on each exposed side of said plurality of panels and said back wall.

* * * * *